US005407286A

United States Patent [19]

Powers

[11] Patent Number: 5,407,286

[45] Date of Patent: Apr. 18, 1995

[54] COSMETIC PENCIL

[76] Inventor: Ronald J. Powers, 4010 Ischia Dr., Oxnard, Calif. 93035

[21] Appl. No.: 169,213

[22] Filed: Dec. 20, 1993

[51] Int. Cl.[6] ..... A45D 40/06; A45D 40/20

[52] U.S. Cl. ..... 401/68; 401/70; 401/73; 401/75; 401/76

[58] Field of Search ..... 401/68, 75, 76, 70, 401/79, 73

[56] References Cited

U.S. PATENT DOCUMENTS

| | | | |
|---|---|---|---|
| 3,106,908 | 10/1963 | Gretz | 401/70 X |
| 3,115,118 | 12/1963 | Anderson et al. | 401/75 |
| 3,176,659 | 4/1965 | Sauber | 401/73 X |
| 3,209,730 | 10/1965 | Aston | 401/76 |
| 3,232,276 | 2/1966 | Kupersmith et al. | 401/75 X |
| 5,230,577 | 7/1993 | Cox et al. | 401/70 X |

FOREIGN PATENT DOCUMENTS

| | | | |
|---|---|---|---|
| 2119320 | 11/1983 | United Kingdom | 401/75 |

*Primary Examiner*—Steven A. Bratlie

*Attorney, Agent, or Firm*—Edgar W. Averill, Jr.

[57] ABSTRACT

A cosmetic pencil for dispensing a soft cosmetic mass having a push rod with an extended head. The cosmetic pencil has a barrel and a hollow sheath is rotatingly held by the barrel. A threaded push rod is keyed so that it turns with the barrel and the sheath has threads near the base of its inner end and as the sheath and barrel are turned with respect to each other the push rod moves outwardly out of the barrel and pushes the cosmetic mass out of the sheath. The head on the threaded push rod is enlarged and may be inserted downstream of the threaded portion of the sheath by a slot and a half thread which permits the widened portion of the push rod to be snapped in front of the threads so that it does not interfere with the threads. The threaded push rod may also have a separate piston snapped thereon. Also the sheath is provided with one way pawls which snap in and out of the grooves on the inside surface of the barrel indicating that the sheath and barrel are being turned with respect to one another.

8 Claims, 3 Drawing Sheets

Fig. 4
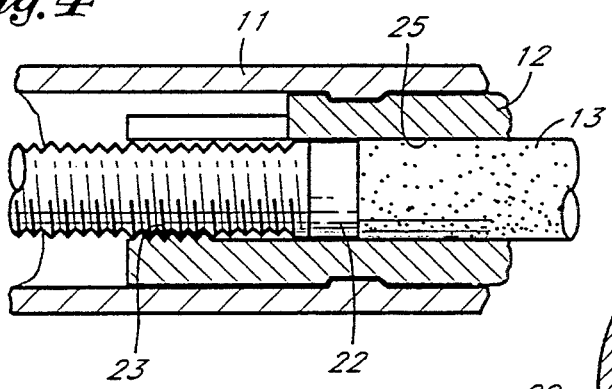
Fig. 5
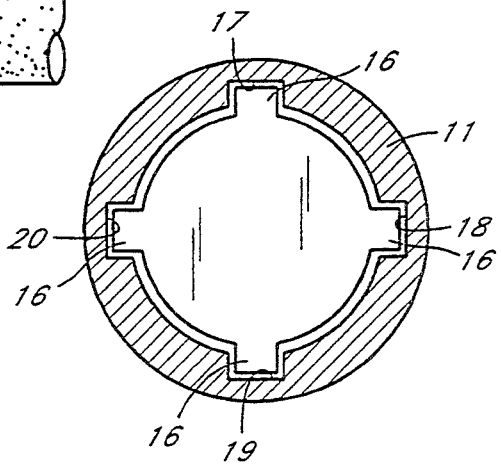
Fig. 6
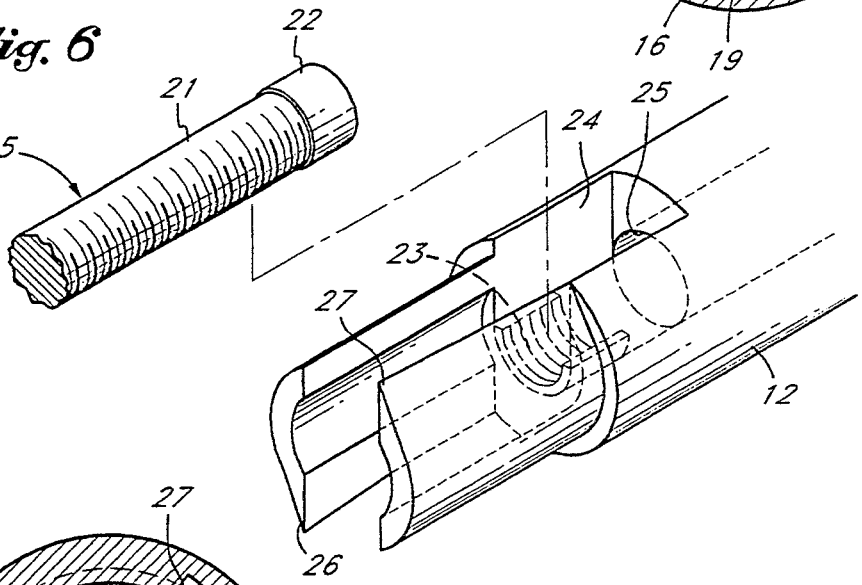
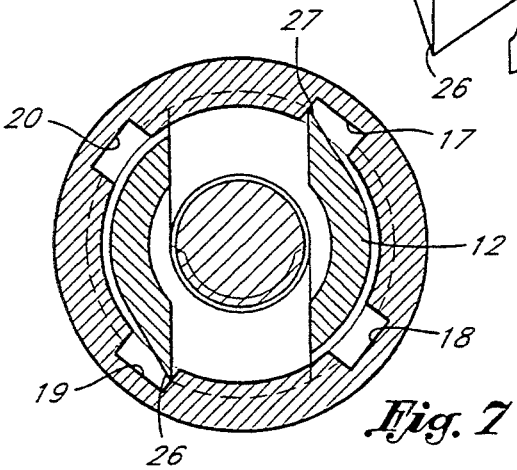
Fig. 7

Fig. 8
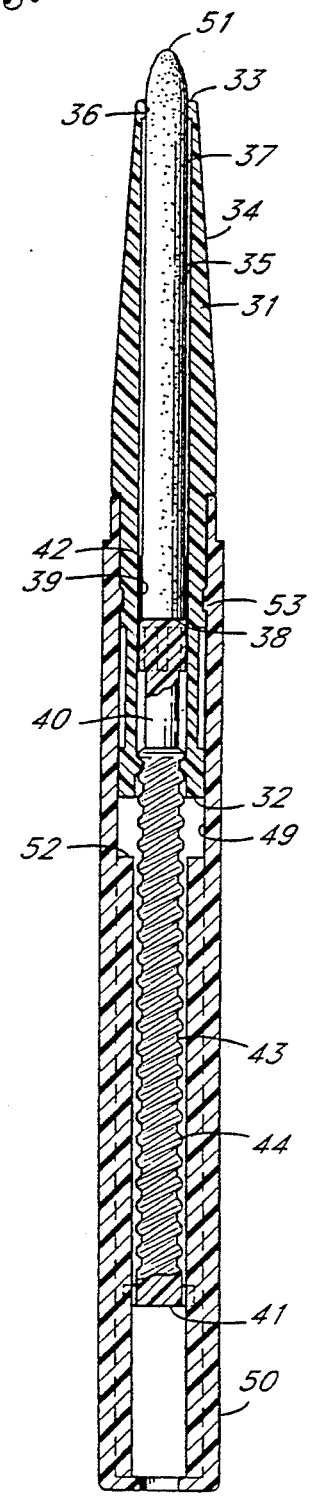
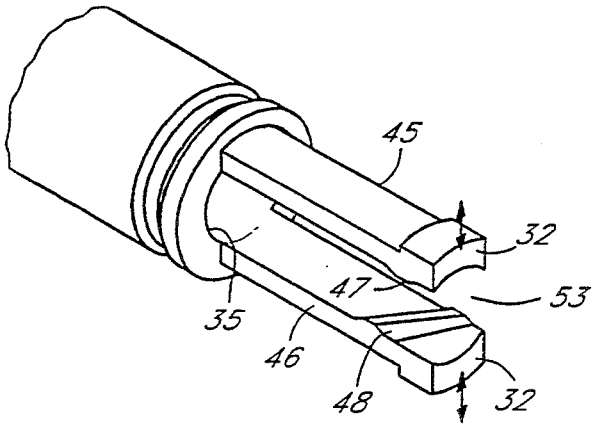
Fig. 9

COSMETIC PENCIL

BACKGROUND OF THE INVENTION

The field of the invention is cosmetic applicators and the invention relates more particularly to cosmetic pencils for dispensing a soft cosmetic mass such as an eyeliner crayon.

A cosmetic pencil of the general type disclosed herein is shown in applicant's U.S. Pat. No. 4,696,594. In this device a push head cylinder 27 is placed within the sheath member prior to filling with a cosmetic mass and the push rod 22 contacts its head. The push rod is advanced by an off-centered disk. While this construction has been very satisfactory, it does require that the sheath be filled from the front and it is advantageous be filled from the rear. It is also advantageous that there be some indication of the advance of the cosmetic mass since this is designed to advance very slowly as the sheath and barrel are turned with respect to one another.

Several cosmetic applicators utilize a threaded push rod which advances outwardly from a barrel. One such device is shown in U.S. Pat. No. 2,563,943. Another design is shown in U.S. Pat. No. 3,219,044. A piston is used in U.S. Pat. No. 3,468,612 to push a liquid cosmetic mass outwardly from a cartridge. Lastly U.S. Pat. No. 2,274,311 shows a push rod within a barrel which is used to advance a rectangular lead or crayon.

SUMMARY OF THE INVENTION

It is an object of the present invention to provide a cosmetic pencil which permits a push rod to have an enlarged head and which further provides a tactile feel as the sheath and barrel are turned with respect to one another.

The present invention is for a cosmetic pencil for dispensing a soft cosmetic mass. The pencil has a generally cylindrical elongated barrel having a hollow sheath rotatingly affixed thereto. The hollow sheath has internal threads near the base thereof which mate with a threaded push rod which moves upwardly as the sheath and barrel are turned with respect to one another. The threads are half threads and a slot is provided which passes in front of the half threads and permits the push rod to be snapped into the half threads with an enlarged head inserted in front of the half threads. This not only facilitates assembly and reduces the number of parts, but also facilitates filling the sheath from the rear. This design also simplifies construction of front filling after assembly in either hot or cold fill. The cold fall is carried out by molding a crayon separately and inserting it so that its base fits into a cup after assembly. This allows the unit to either propel or repel the cosmetic mass. The unit has a reduced number of components.

BRIEF DESCRIPTION OF THE DRAWINGS

FIG. 4 is an enlarged view taken along 4—4 of FIG. 2.

FIG. 5 is an enlarged cross-sectional view taken along line 5—5 of FIG. 2.

FIG. 6 is an exploded perspective view of the half thread portion of the sheath and the push rod of the cosmetic pencil of FIG. 1.

FIG. 7 is a cross-sectional view taken along line 7—7 of FIG. 2.

FIG. 8 is a cross-sectional view of an alternate embodiment of the cosmetic pencil of FIG. 1.

FIG. 9 is an exploded perspective view of the interior end of the hollow sheath of the pencil of FIG. 8.

DESCRIPTION OF THE PREFERRED EMBODIMENTS

Figure 1:
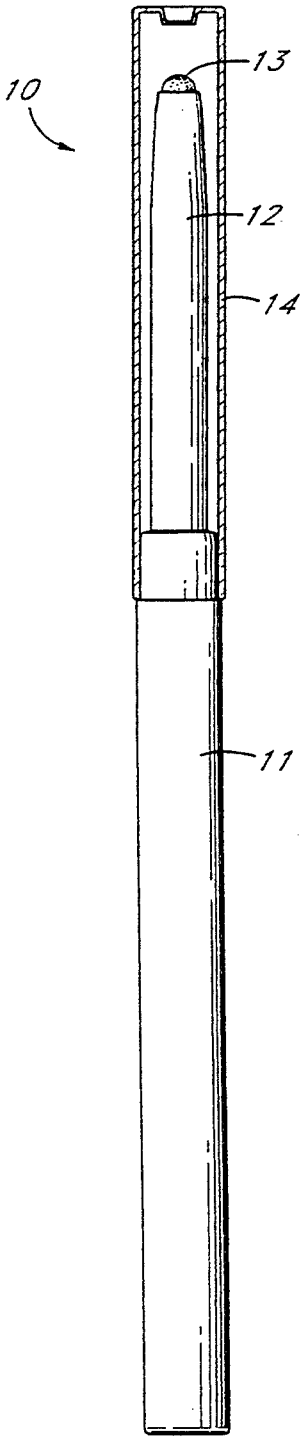
FIG. 1 is a side view partly in cross-section of the cosmetic pencil of the present invention.

The cosmetic pencil of the present invention is shown in side view in FIG. 1 and indicated generally by reference character 10. Cosmetic pencil 10 has a barrel 11, a sheath 12 which contains a cosmetic mass 13. A cap 14 snaps onto the upper end of barrel 11.

Figure 2:
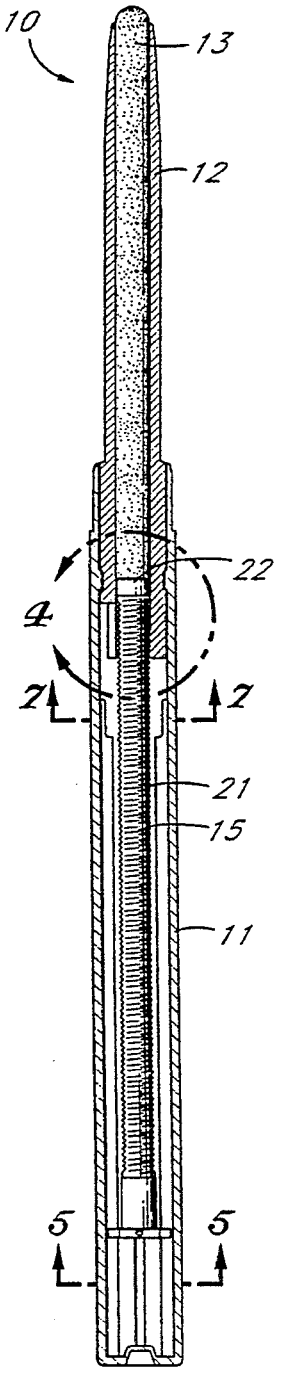
FIG. 2 is a cross-sectional side view of the pencil of FIG. 1.
Figure 3:
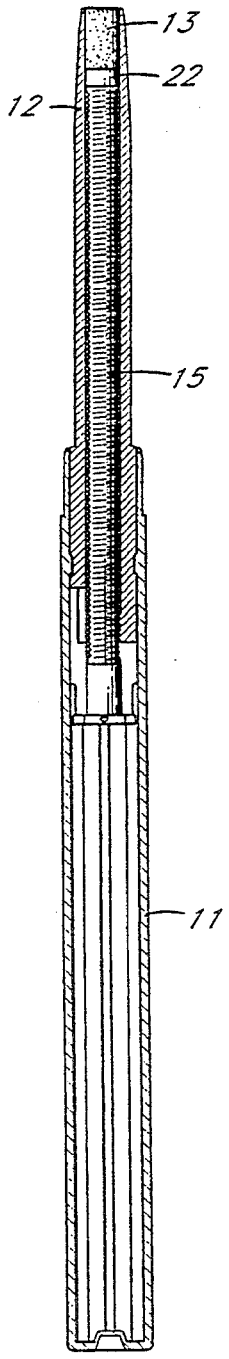
FIG. 3 is a cross-sectional side view of the pencil of FIG. 1 with the cosmetic mass almost completely extruded out of the sheath.

The cosmetic pencil 10 of FIG. 1 is shown in cross-sectional view in FIG. 2 where it can be seen that a threaded push rod 15 is held within barrel 11. The threaded push rod is provided with tabs 16 which cause it to turn with barrel 11. Barrel 11 is provided with grooves 17, 18, 19 and 20. Push rod 15 has external threads 21 and an enlarged head 22. The enlarged head facilitates the extrusion of cosmetic mass 13 out of sheath 12.

Turning now to FIG. 6, the construction of the base of sheath 12 may be seen. A half thread 23 is molded in the base of a slot 24 which permits the threads 21 and the enlarged head 22 to be pushed downwardly as indicated in FIG. 6 so that threads 21 mate with half threads 23. Slot 24 also permits the injection of cosmetic mass into the opening 25 of sheath 12.

Another feature of the present invention is indicated in FIG. 7 where pawls 26 and 27 fit into grooves 17 and 19 as can be seen by viewing FIG. 7. The sheath 12 may be turned clockwise and pawls 26 and 27 will move out of grooves 17 and 19 and will then snap into grooves 18 and 20. Trying to turn sheath 12 counter clockwise, however, would cause the pawls to abut the edges of the grooves preventing a counter clockwise turning.

While push rod 15 is shown as having an integrally molded enlarged head 22, head 22 may instead be a separate piece which is snapped on to the end of threaded push rod 15. This permits the enlarged head to be made from a softer more elastic polymer so that it will cleanly expel the cosmetic mass 13 from the cylindrical opening 25 of sheath 12.

An alternate embodiment of the cosmetic pencil is shown in cross-sectional view in FIG. 8 where the cosmetic mass or crayon 3 is held in a hollow sheath 31, having an interior end 32, an exterior end 33, an outer surface 34, an inner surface 35 and a tip support ring 36. Support ring 36 touches the outer surface 37 of crayon 30.

Crayon 30 has a base 38 which is surrounded by a cup 39 which is part of elongated push rod 40. Rod 40 has a base 41, a tip 42, and an elongated shank 43, a portion of which is threaded and one of the threads is indicated by reference character 44.

A pair of flexible arms 45 and 46 are shown in FIG. 9 and each of the flexible arms has a partial thread indicated by reference characters 47 and 48, respectively. This permits the threaded portion to be flexed to permit the entry of an enlarged portion such as cup 39. The partial threads on flexible arms 45 and 46 are supported in a closed configuration by contact with the inner surface 49 of barrel 50.

The configuration shown in FIGS. 8 and 9 has the advantage of being able to propel the tip 51 past the exterior end 33 of hollow sheath 35 or to repel tip 51 backward so that it withdraws interiorly of exterior end 31.

The design of the present invention is unique in that it has a very small number of parts. Specifically, crayon 30 is held in the cup portion of elongated push rod 40 which in turn is threadably held by hollow sheath 31 as well as by the inner surface of hollow barrel 50. The base 41 is enlarged and has a groove which mates with key 52 which is integrally formed along the inner surface 49 in barrel 50. The barrel 50 and hollow sheath 36 are snapped together as indicated at reference character 54 where there is a conventional ring and groove attachment which permits them to turn with respect to each other but they are securely snapped together so that they will not come apart during use. In practice the cup 39 would be pushed into the slot 53 between arms 45 and 46 and the cup would be placed downstream of the partial threads 47 and 48. After it has been inserted then the barrel 50 may be snapped over the base of hollow sheath 36 which further helps retain the partial threads in contact with the threaded portion of shank 43.

This design permits either hot or cold filling because the flexible arms 45 and 46 will slightly spread apart to permit the entry of a filling tip between them.

The parts are preferably injection molded and thus, it can be seen that a highly useful cosmetic pencil can be formed with three basic parts in addition to a crayon.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A cosmetic pencil for dispensing a soft cosmetic mass, said cosmetic pencil comprising:

a generally cylindrical elongated hollow barrel having a bottom, a top, an outer surface and an inner surface;

an elongated push rod having a bottom and a top and being threaded and including means to prevent said push rod from being turned with respect to said barrel; and a hollow sheath having a bottom, a top, an outer surface and an inner surface, said sheath having a threaded portion which mates with the threaded push rod, said threaded portion being a partial thread which does not extend completely around the inner surface of said hollow sheath and having a slot adjacent said partial thread of sufficient width so that the threaded push rod may be passed radially through said slot and onto said partial thread.

2. The cosmetic pencil of claim 1 wherein the push rod has an enlarged head to assist the pushing of the cosmetic mass out of the sheath.

3. The cosmetic pencil of claim 2 wherein said enlarged head of said push rod is a separate part.

4. The cosmetic pencil of claim 1 wherein said threaded portion of said hollow sheath is a single threaded portion.

5. The cosmetic pencil of claim 1 wherein said threaded portion of said hollow sheath has two opposed threaded portions.

6. The cosmetic pencil of claim 5 wherein said two opposed threaded portions are positioned near an end of two flexible arms.

7. The cosmetic pencil of claim 6 wherein the tip of said elongated push rod includes a cup and wherein an elongated stick of cosmetic mass has a base surrounded by said cup, an elongated, cylindrical length and a tip whereby said cosmetic pencil may propel and repel the tip of said cosmetic mass out past the exterior end of said hollow sheath and may repel the tip of the cosmetic mass inwardly from the exterior end of said hollow sheath.

8. The cosmetic pencil of claim 4 wherein said single threaded portion is a half thread and said slot is a single slot opposite said half thread large enough so that the push rod may be moved radially therethrough onto said half thread.

* * * * *